US005732498A

United States Patent [19]

Arreguin

[11] Patent Number: 5,732,498

[45] Date of Patent: Mar. 31, 1998

[54] TAMPER PROOF MULTI-FUNCTIONAL MULTIPURPOSE FIREARM SAFETY LOCK

[76] Inventor: Phillip M. Arreguin, 8572 Davmor Ave., Garden Grove, Calif. 92641

[21] Appl. No.: 550,454

[22] Filed: Oct. 30, 1995

[51] Int. Cl.[6] ..... F41A 17/44

[52] U.S. Cl. ..... 42/70.11; 42/70.02

[58] Field of Search ..... 42/70.02, 70.11, 42/70.01

[56] References Cited

U.S. PATENT DOCUMENTS

| | | | |
|---|---|---|---|
| 2,836,918 | 6/1958 | Pula et al. | 42/70.11 |
| 2,923,323 | 2/1960 | Franck | 42/70.11 |
| 5,115,589 | 5/1992 | Shuker | 42/70.11 |
| 5,488,794 | 2/1996 | Arreguin | 42/70.11 |

*Primary Examiner*—Stephen M. Johnson
*Attorney, Agent, or Firm*—Michael I. Kroll

[57] ABSTRACT

A tamper proof multi-functional multipurpose safety lock is provided which will render a firearm inoperable until a person utilizes a collapsible rod key coded tool head is used to remove the safety lock. A contoured insert is placed into an ejection port on a slide when the slide is in its most rearward position. The contoured insert has a socket, so that it will accept a lug on a dummy cartridge that is carried in a magazine. When a keeper is inserted into the barrel with the collapsible rod key coded tool head, the keeper will lock the dummy cartridge to the contoured insert. Accordingly, the firearm will be completely locked up including the magazine and the slide. In firearms that do not have magazines the dummy cartridge is eliminated.

43 Claims, 14 Drawing Sheets

Fig. 11
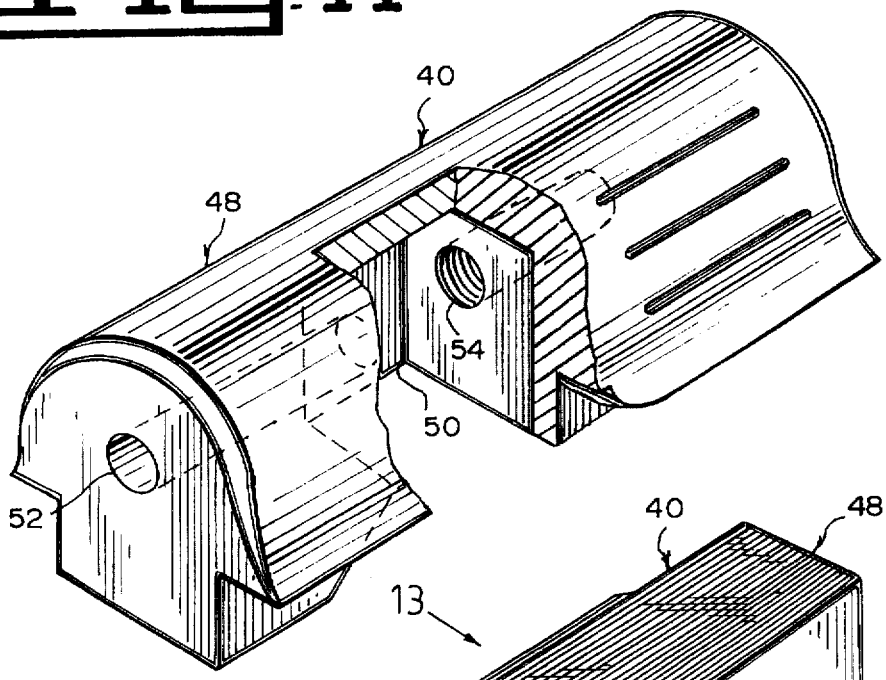
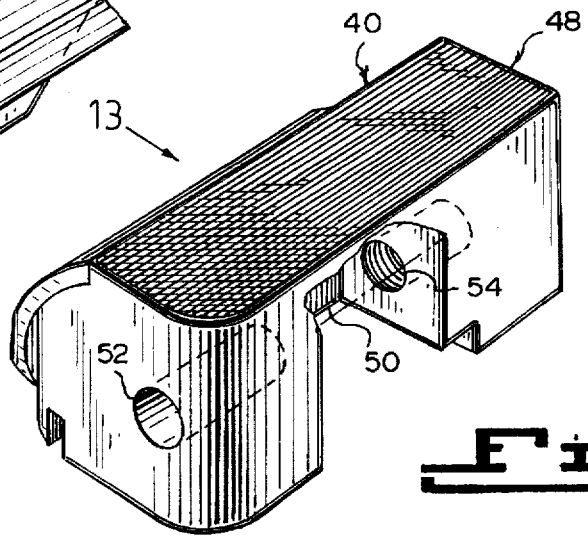
Fig. 12
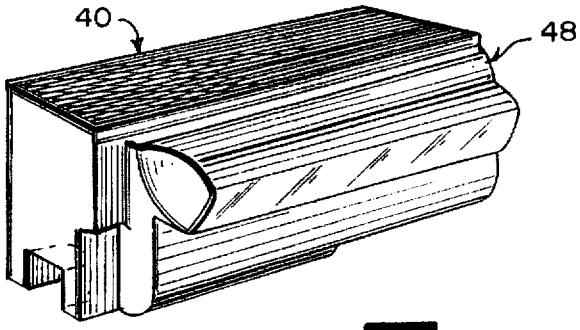
Fig. 13

TAMPER PROOF MULTI-FUNCTIONAL MULTIPURPOSE FIREARM SAFETY LOCK

BACKGROUND OF THE INVENTION

1. Field of the Invention

The instant invention relates generally to gun discharge preventing devices and more specifically it relates to a tamper proof multi-functional multipurpose safety lock.

2. Description of the Prior Art

Numerous gun discharge preventing devices have been provided in prior art. For example, U.S. Pat. No. 4,619,062 to Johnson; U.S. Pat. No. 5,048,211 to Hepp; U.S. Pat. No. 5,357,704 to Benkovic and U.S. Pat. No. 5,361,525 to Bowes all are illustrative of such prior art. While these units may be suitable for the particular purpose to which they address, they would not be as suitable for the purposes of the present invention as heretofore described.

JOHNSON, DAVID A.

SAFETY DEVICE FOR FIREARMS USING REMOVABLE MAGAZINES

U.S. Pat. No. 4,619,062

A safety device for a repeating firearm includes a main body which fits in the magazine well of the firearm, closing its outer end. An outer end of the main body is clearly visible at the outer end of the magazine well when the main body is properly located therein. A chamber-blocking member movable attached to the main body excludes cartridges from the firing chamber of the weapon and, in one embodiment of the invention, includes a barrier which prevents a firing pin from reaching the primer of a cartridge which may be located in the firing chamber undetected. The chamber-blocking member, in one embodiment of the invention, is pivotably attached to the main body. In another embodiment of the invention the chamber-blocking member is a cylindrical plug attached to the main body by a flexible cable.

HEPP, NORBET

SAFETY LOCK FOR FIREARMS

U.S. Pat. No. 5,048,211

A chamber and bore lock for a firearm includes a rod adapted for receipt within the barrel bore of the firearm. One end of the rod has a fixed plug with an abutting O-ring. A pair of sleeves are received upon the rod with an O-ring therebetween. A threaded cap engages and end of the rod at the muzzle of the firearm, such that threaded movement of the cap draws the plug toward the cap, urging the sleeves into compressing and radially deforming engagement with the O-rings which engage inner circumferential surfaces of the barrel bore and firing chamber of the firearm.

BENKOVIC, IVAN

FIREARM LOCK

U.S. Pat. No. 5,357,704

A gun lock including a hardened steel rod threaded at each end, the threaded ends respectively engaging a cartridge shaped plug and a rotatable tumbler lock. The lock is fixed within a sleeve body adapted to fit snugly around a barrel end of a gun to be locked. The cartridge plug fits snugly within the firing chamber of the gun, in the same manner as a cartridge adapted to be fired within the gun. With the cartridge plug within the firing chamber and with the rod threadedly engaged in the lock, the rod can be inserted down the bore of the gun and threadedly the cartridge plug by rotating a mating key engaged in the lock, until the device is snug. Removal of the key results in securing the gun lock within the gun. A slot within the sleeve body engages an aiming sight of the gun, so as to prevent rotation of the sleeve. The end of rod, rather than being threaded, may include a circumferential groove which can be lockingly engaged by a set of wedge driven diametrically restricting detent balls, the wedge driving mechanism being threadedly driven by the lock within an alternative arrangement of the sleeve body.

BOWES, KENNETH E.

GUN SAFETY LOCK

U.S. Pat. No. 5,361,525

An improved gun safety lock is disclosed which employs a barrel key to enable the firing mechanism of the gun. The barrel key is inserted in the handle of the gun, to allow the hammer of the weapon to be moved into a cocked or firing position. The barrel key is unique for each gun. The barrel key is held in the gun by retaining lugs. A lanyard attaches to the barrel key on one end and to the owner of the gun on the other end. Pressure on the lanyard causes the key to pull out of the gun and thereby disables the gun.

SUMMARY OF THE INVENTION

A primary object of the present invention is to provide a tamper proof multi-functional multipurpose safety lock that will overcome the shortcomings of the prior art devices.

Another object is to provide a tamper proof multi-functional multipurpose safety lock that will render a firearm inoperable until a person utilizes a collapsible rod key coded tool head to remove the safety lock.

An additional object is to provide a tamper proof multi-functional multipurpose safety lock that can be used on firearms that have magazines, for example, pistols and on firearms that do not have magazines, for example, shotguns which are bolt action and lever action.

A further object is to provide a tamper proof multi-functional multipurpose safety lock that is simple and easy to use.

A still further object is to provide a tamper proof multi-functional multipurpose safety lock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 11 is an enlarged front top perspective view of the contoured insert broken away and in section as indicated by arrow 11 in FIG. 1A.

FIG. 12 is an enlarged front top perspective view of the contoured insert broken away, as indicated by arrow 12 in FIG. 2.

FIG. 13 is a rear top perspective view taken in the direction of arrow 13 in FIG. 12.

Similar reference characters denote corresponding features consistently throughout the attached drawings.

DETAILED DESCRIPTION OF THE PREFERRED EMBODIMENTS

Figures 1, 1A:
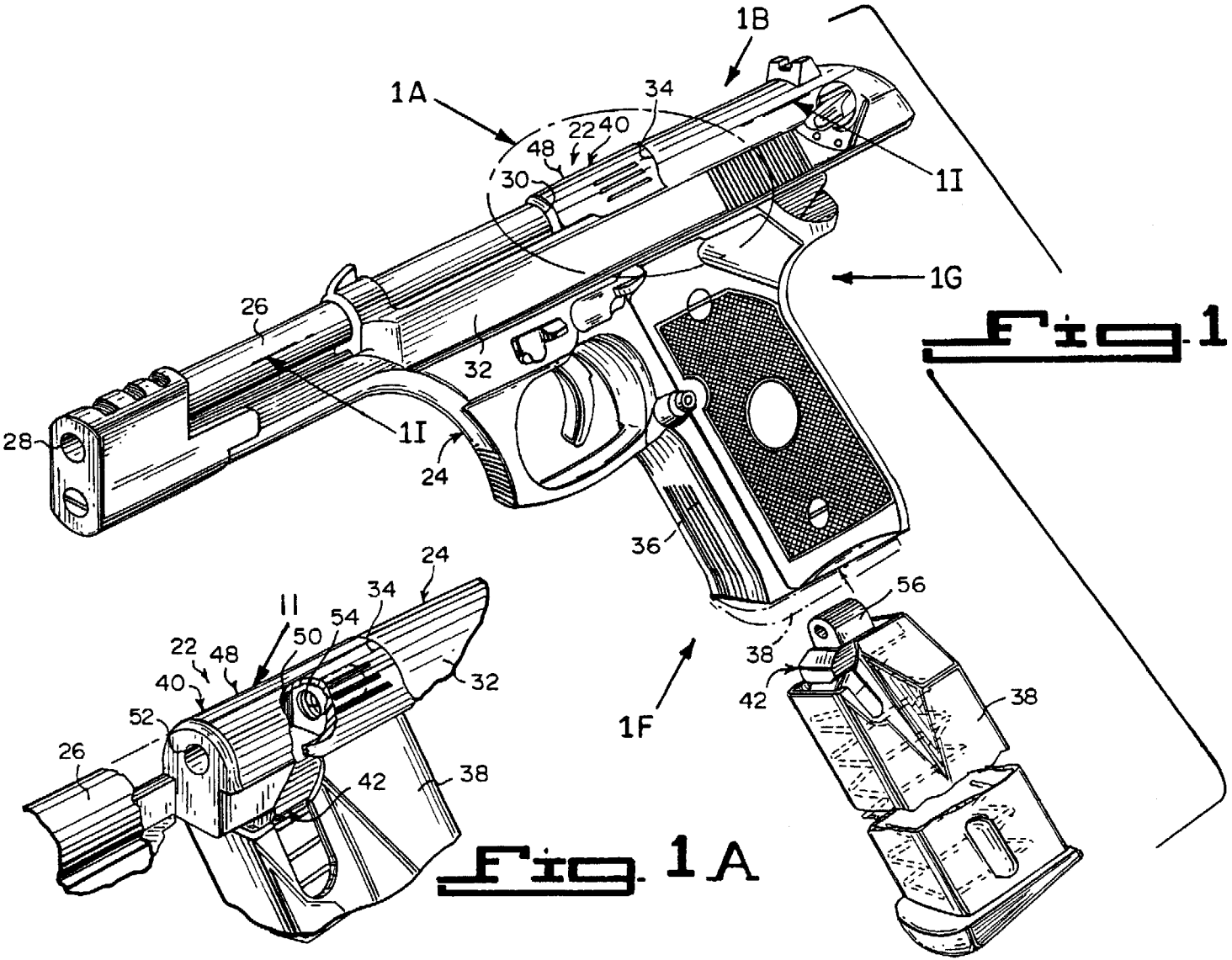
FIG. 1 is a front top perspective view of a firearm, which is a 9 mm M-9 92SB-F Beretta pistol with the contoured insert in place and the dummy cartridge in the magazine, ready to be inserted within the magazine well.
FIG. 1A is an enlarged front top perspective view with parts broken away, as indicated by arrow 1A in FIG. 1.
Figures 1B, 1C, 1D, 1E, 1F:
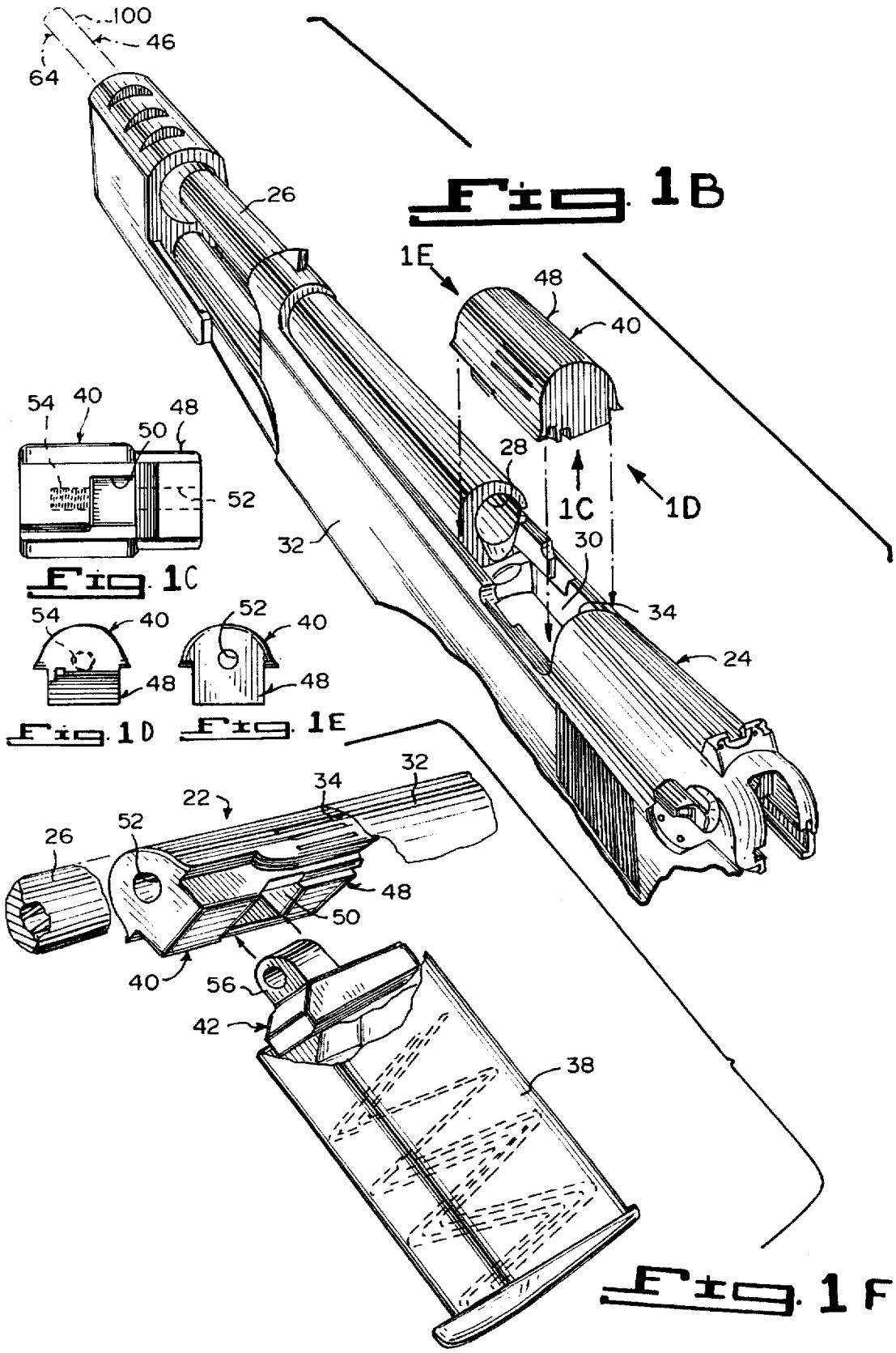
FIG. 1B is a rear top perspective view with parts broken away and removed, as indicated by arrow 1B in FIG. 1.
FIG. 1C is a bottom elevational view of the contoured insert, as indicated by arrow 1C in FIG. 1B.
FIG. 1D is a rear elevational view of the contoured insert, as indicated by arrow 1D in FIG. 1B.
FIG. 1E is a front elevational view of the contoured insert, as indicated by arrow 1E in FIG. 1B.
FIG. 1F is a front bottom perspective view with parts broken away and removed, as indicated by arrow 1F in FIG. 1.
Figures 1G, 1H, 1I:
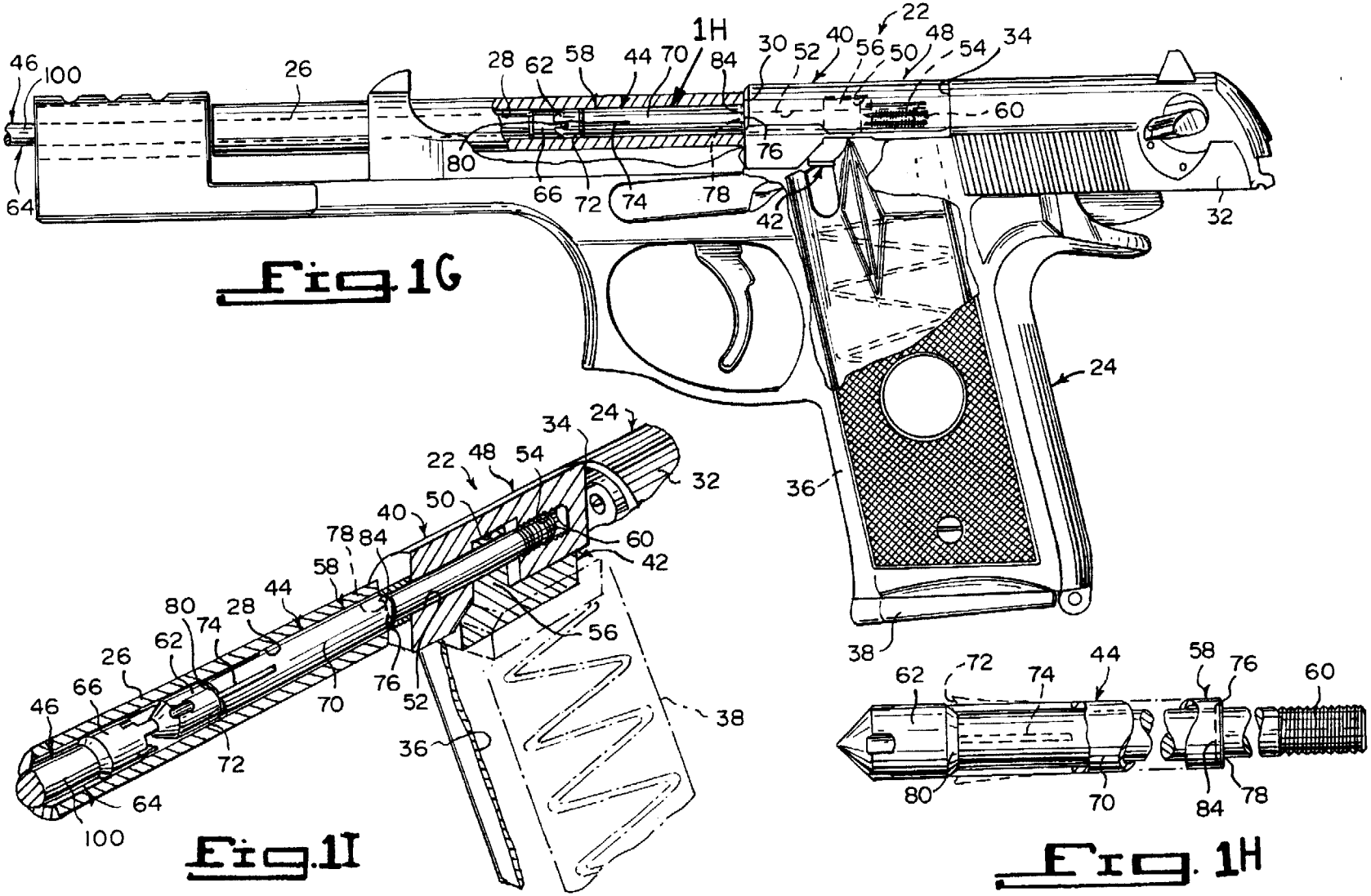
FIG. 1G is a left side elevational view with parts broken away, taken in the direction of arrow 1G in FIG. 1.
FIG. 1H is an enlarged left side elevational view of the keeper, as indicated by arrow 1H in FIG. 1G, with parts broken away and in phantom phase.
FIG. 1I is a cross sectional perspective view taken along line 1I—1I in FIG. 1, with parts broken away and in phantom phase.

Turning now descriptively to the drawings, in which similar reference characters denote similar elements throughout the several views, FIGS. 1 through 22 illustrate a tamper proof multi-functional multipurpose safety lock 22 for use in a firearm 24 of the type having a barrel 26 with a bore 28 therethrough, a cartridge receiver firing chamber breech 30, a longitudinally movable slide 32 with an ejection port 34 and a magazine well 36, for receiving a removable magazine 38 that is capable of holding cartridges to be fed one at a time into the cartridge receiver firing chamber breech 30. The safety lock 22 comprises a contoured insert 40 that fits past the ejection port 34 of the slide 32 when the slide 32 is in its most rearward position, so that the contoured insert 40 can fit into the cartridge receiver firing chamber breech 30 of the firearm 24.

A dummy cartridge 42 is carried on a top end of the magazine 38, so that when the magazine 38 is inserted into the magazine well 36, a portion of the dummy cartridge 42 will engage with the contoured insert 40. A keeper 44 is adapted to be inserted into the bore 28 of the barrel 26 of the firearm 24.

A tool head 46 is insertable into the barrel 26 of the firearm 24 to engage the keeper 44. In a first instance, the collapsible rod key coded tool head 46 can cause the keeper 44 to expand in the barrel 26 and lock the dummy cartridge 42 to the contoured insert 40, making the firearm 24 inoperable by preventing the firearm 24 from being fired. In a second instance, the collapsible rod key coded tool head 46 can cause the keeper 44 to unlock the dummy cartridge 42 from the contoured insert 40. The keeper 44 can be removed from the bore 28 of the barrel 26, the magazine 38 can be removed from the magazine well 36, the dummy cartridge 42 can be removed from the magazine 38 and the contoured insert 40 can be removed from the cartridge receiver firing chamber breech 30, making the firearm 24 operable to be fired.

The contoured insert 40 is a generally block shaped member 48, shaped to fit into the cartridge receiver firing chamber breech 30 of the firearm 24. The block shaped member 48 has a centrally located bottom socket 50 vertically extending therein, a forward horizontal aperture 52 and a rearward horizontal threaded hole 54 that is in alignment with the forward horizontal aperture 52. The dummy cartridge 42 contains an upstanding lug 56 which fits into the bottom socket 50 in the block shaped member 48.

The keeper 44 consists of a cylindrical housing 58. A threaded shank 60 extends from a rearward end of the cylindrical housing 58 to pass through the forward horizontal aperture 52, the upstanding lug 56 and thread into the rearward horizontal threaded hole 54 in the block shaped member 48. A quadrilaterial shaped head 62 extends from a forward end of the cylindrical housing 58 to be operable by the collapsible rod key coded tool head 46.

The collapsible rod key coded tool head 46 includes an elongated shaft 64 having a quadrilaterial countersunk shaped socket 66 at a first end to fit over the quadrilaterial shaped head 62 on the keeper 44, so as to rotate the keeper 44 to thread and unthread the threaded shank 60 with the rearward horizontal threaded hole 54 in the block shaped member 48. An operating handle 68 is on a second end of the elongated shaft 64, so as to turn the elongated shaft 64.

The cylindrical housing 58 is a hollow sleeve 70, having an open forward end 72 with a plurality of slots 74 thereabout and a closed rearward end 76 having a countersunk hole 78 therethrough. A quadrilaterial neck 80 connects the quadrilaterial shaped head 62 to the threaded shank 60, which extends through the hollow sleeve 70 and out of the countersunk hole 78. When the threaded shank 60 is tightened into the rearward horizontal threaded hole 54 in the block shaped member 48, the quadrilaterial neck 80 will cause the open forward end 72 of the hollow sleeve 70 to expand and engage with the bore 28 in the barrel 26 of the firearm 24.

The threaded shank 60 has a countersunk octagon shaped groove 82 thereabout at the countersunk hole 78 in the closed rearward end 76 of the hollow sleeve 70. An E-clip 84, best seen in FIG. 17D, is flush on the countersunk octagon shaped groove 82 in the threaded shank 60, to retain the hollow sleeve 70 in a rotative position on the threaded shank 60.

The operating handle 68 of the collapsible rod key coded tool head 46 has a knurled surface 86, so that a person can better grip the operating handle 68 to turn the elongated shaft 64. The operating handle 68 has a transverse opening 88 therethrough. A key ring 90 extends through the transverse opening 88, so that the collapsible rod key coded tool head 46 when collapsed can be carried by the key ring 90.

A belt clip 92 is affixed to the operating handle 68, so that the collapsible rod key coded tool head 46 can be attached by the belt clip 92 to a belt worn on an individual person. The operating handle 68 has a pair of storage compartments 94, for holding various oils, adaptors and currency therein. A pair of caps 96 are provided. Each cap 96 will removably seal one compartment 94 watertight in the operating handle 68, when not in use.

Figures 18, 19, 20, 21:
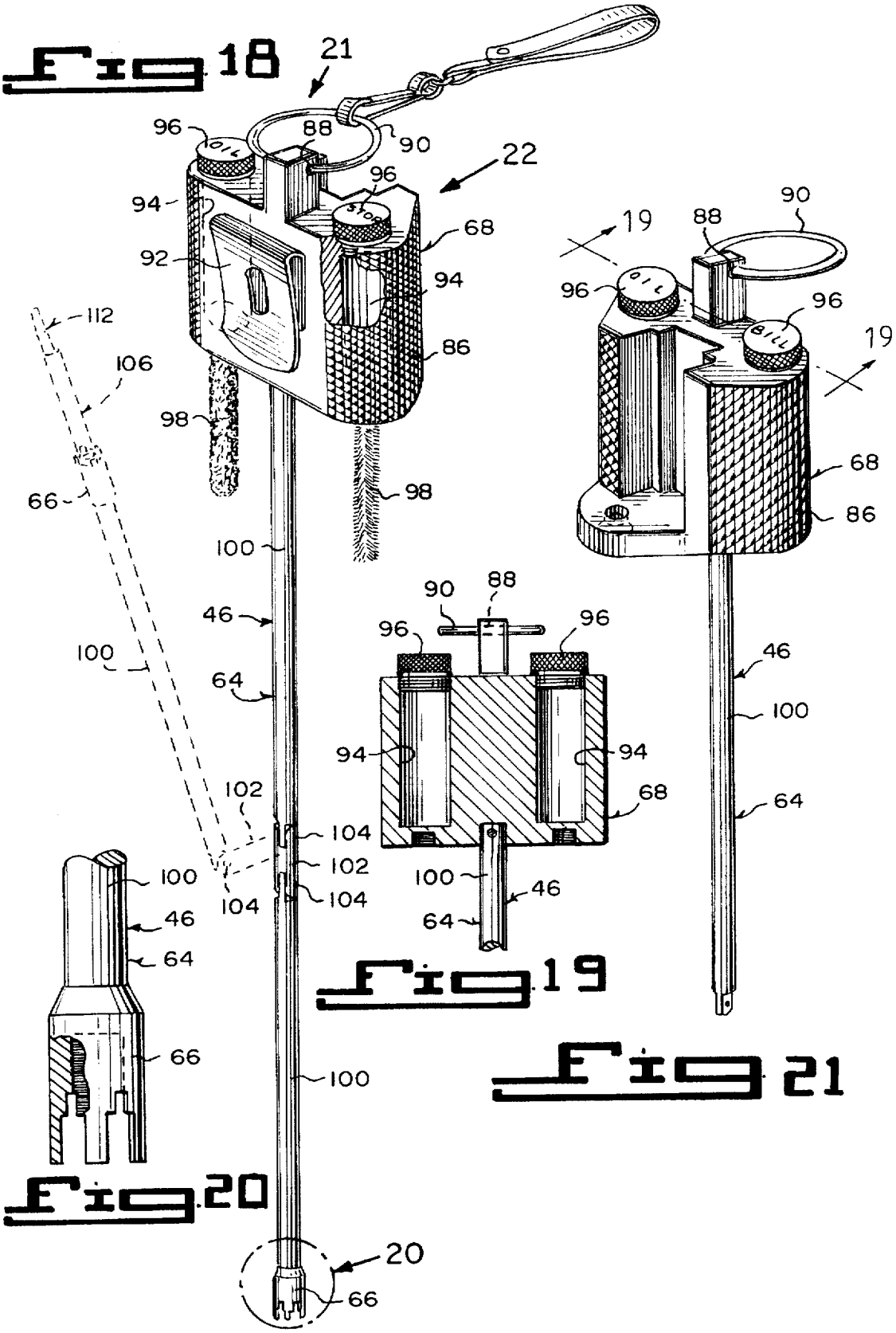
FIG. 18 is a rear top perspective view of the collapsible rod key coded tool head, taken in the direction of arrow 18 in FIG. 4.
FIG. 19 is a cross sectional view taken along line 19—19 in FIG. 21.
FIG. 20 is an enlarged elevational view as indicated by arrow 20 in FIG. 18, showing the quadrilaterial countersunk shaped socket in greater detail.
FIG. 21 is a front top perspective view of the collapsible rod key coded tool head as indicated by arrow 21 in FIG. 18, with a portion of the elongated shaft removed therefrom.
Figure 22:
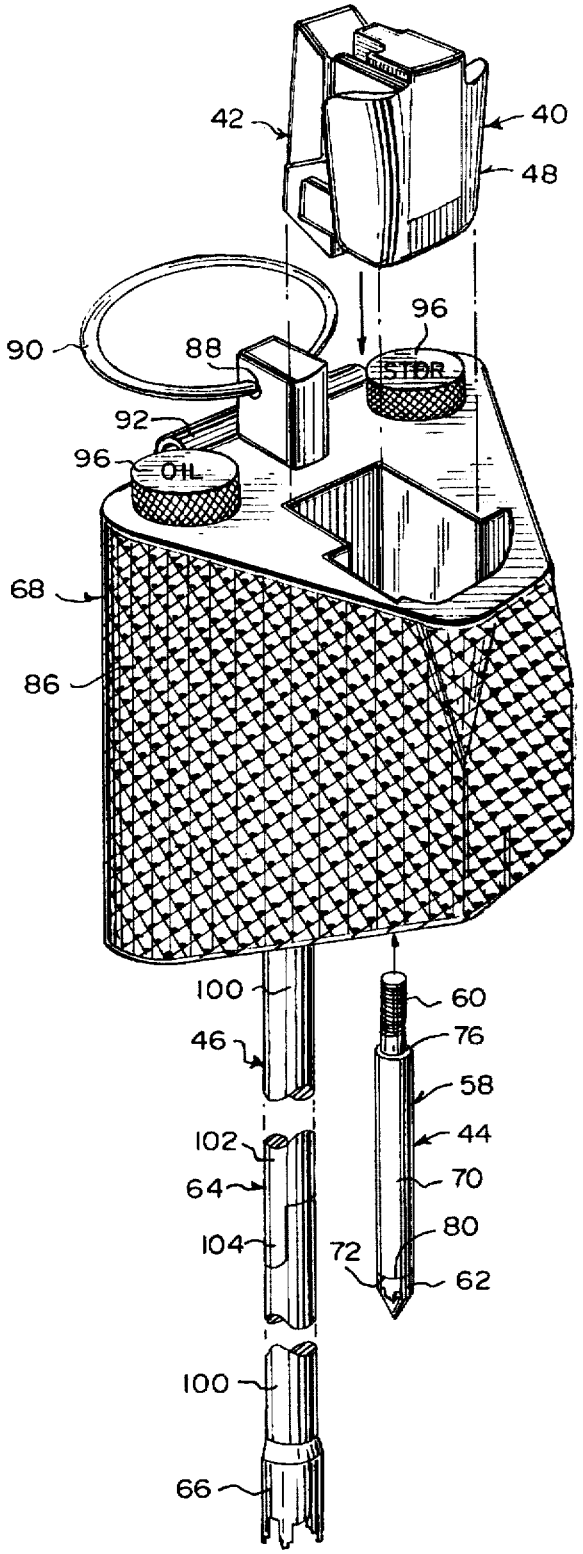
FIG. 22 is a front top perspective view of a modified collapsible rod key coded tool head as indicated by arrow 22 in FIG. 18, with parts broken away and exploded therefrom.

A pair of wire brush cleaning elements 98, as shown in FIG. 18, are affixed to the operating handle 68, to be used for cleaning the firearm 24. The elongated shaft 64 is separated into two long segments 100 and one short segment 102, which is hinged at 104 between the two long segments 102, so that the elongated shaft 64 can be folded upon itself for storage when not in use.

Figure 17A:
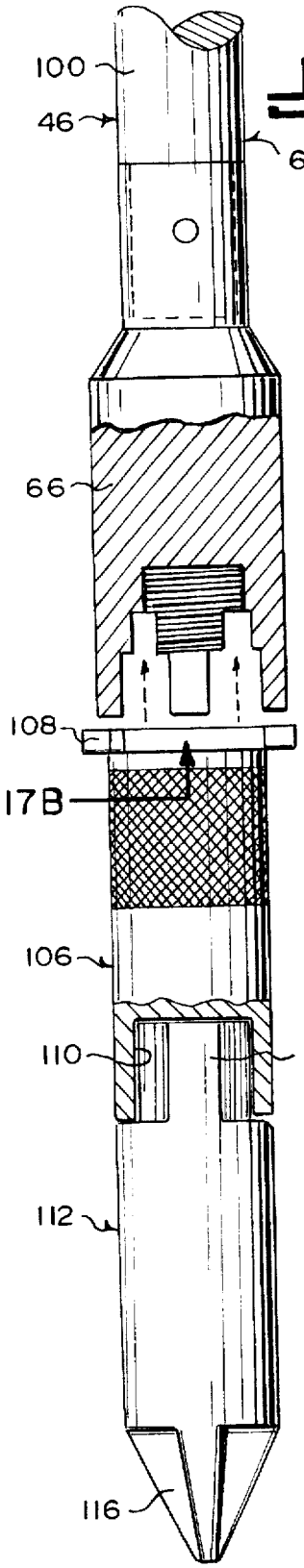
FIG. 17A is an enlarged elevational view partly in section, showing the quadrilaterial countersunk shaped socket of the collapsible rod key coded tool head ready to be connected to an adaptor.
Figure 17B:
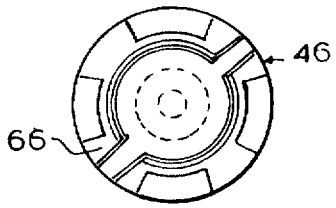
FIG. 17B is a bottom view of the quadrilaterial countersunk shaped socket, taken in the direction of arrow 17B in FIG. 17A.
Figure 17C:
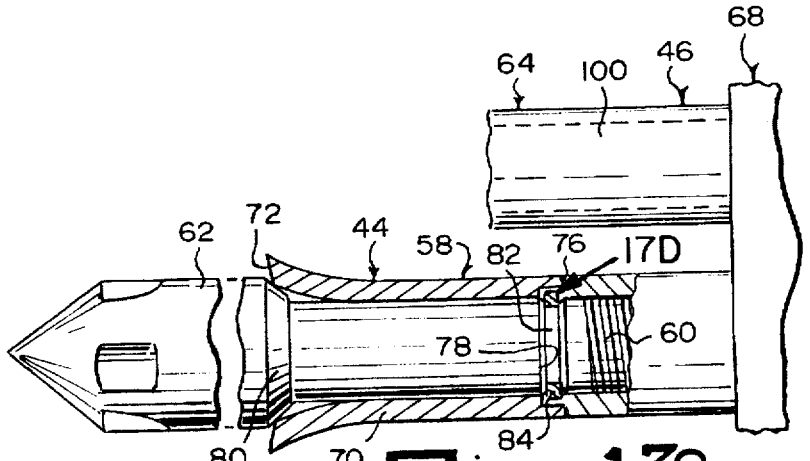
FIG. 17C is a side elevational view with parts broken away and in section, showing the keeper connected to the operating handle of the collapsible rod key coded tool head for storage when not in use.
Figure 17D:
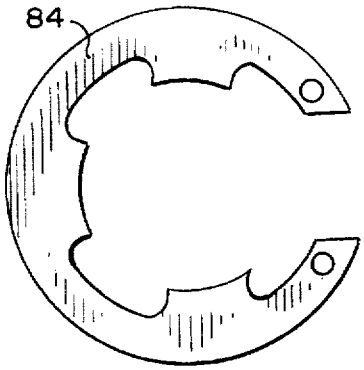
FIG. 17D is a front elevational view of the E-clip as indicated by arrow 17D in FIG. 17C that is used in the keeper.

The collapsible rod key coded tool head 46, as shown in FIG. 17A, further includes an adaptor 106, having a bridge head 108 at a first end to fit into the quadrilaterial countersunk shaped socket 66 on the elongated shaft 64 and a hex socket adaptor 110 at a second end. A shank 112 has a hex head 114 at a first end to fit into the hex socket 110 in the adaptor 106. A Phillips head 116 is at a second end, so that the collapsible rod key coded tool head 46 can now be converted into a Phillips head screwdriver.

TWO VERSIONS OF THE TAMPER PROOF MULTI-FUNCTIONAL MULTIPURPOSE FIREARM SAFETY LOCK

TYPE A (magazine version for use with firearms that have magazines)

Has four components:

1. Contoured insert 40 that fits into cartridge receiver firing chamber beech 30 to accept dummy cartridge 42 and keeper 44.
2. Dummy cartridge 42 that fits into magazine 38 and locks magazine 38 in place when keeper 44 is locked onto contoured insert 40.
3. Keeper 44 that fits into barrel 26 and locks dummy cartridge 42 to contoured insert 40.
4. Collapsible rod key coded tool head 46 that tightens keeper 44.

Figure 2:
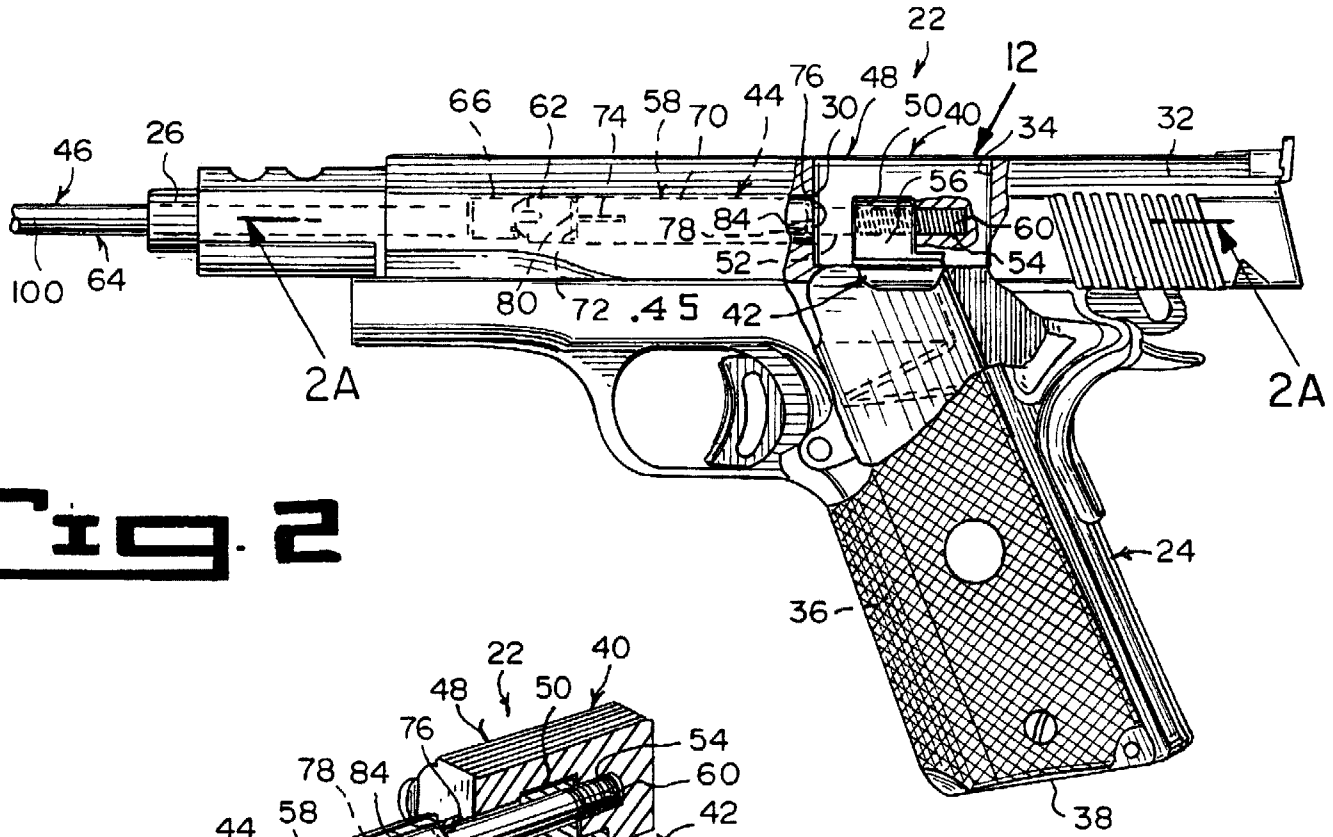
FIG. 2 is a left side elevational view with parts broken away of a firearm, which is a 45 caliber pistol with the contoured insert and the dummy cartridge in the magazine in place and the keeper being secured by the collapsible rod key coded tool head.
Figure 2A:
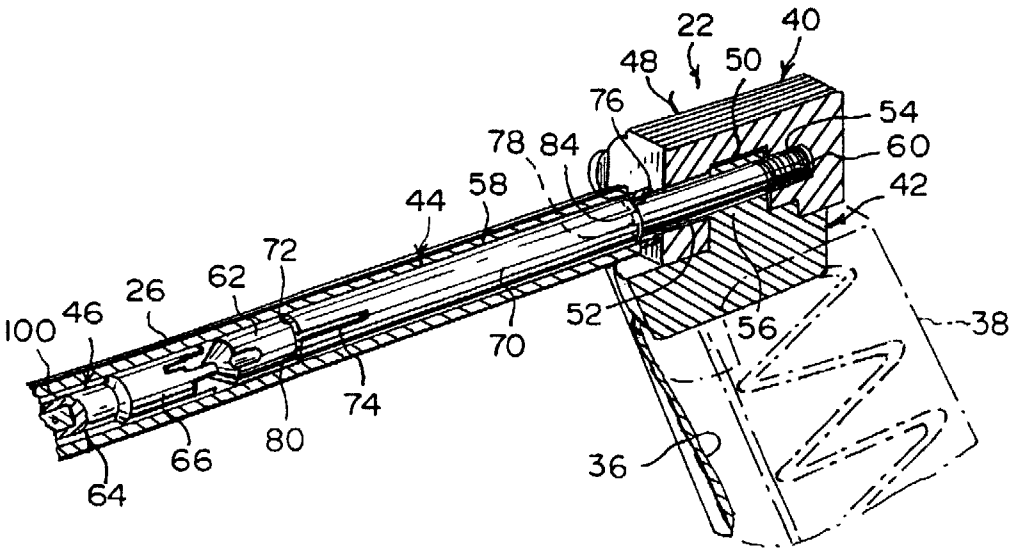
FIG. 2A is a cross sectional perspective view taken along line 2A—2A in FIG. 2, with parts broken away and in phantom phase.

Used on the following manufactured firearms that have magazines:

(List is by no means exhaustive.)

a. 45 cal. model 1911-/AIM-1991-/A1 (seen in FIGS. 2 and 2A)

b. 9mm M-9 92SB-F Beretta (seen in FIGS. 1, 1A, 1B, 1F, 1G and 1I)

c. Sig-Sauer P228M-11-9 mm (seen in FIGS. 3, 3A and 3C)

d. M16M-4 5.56 mm 223 caliber (seen in FIG. 14)

e. Assault type weapons f. Uzi-9 mm M-1M1-SMG g. Internal external slide action weapons h. Bolt action weapons i. Lever action weapons j. HKMP5 k. OICW objective (JSSAP) Individuals-56 combat weapons (1999)

l. Slide action weapons m. Shot guns with clips n. Step loading without working the slide

TYPE B (non-magazine version for use with firearms that do not have magazines)

Has three components:

1. Contoured insert 40 that fits into cartridge receiver firing chamber breech 30.
2. Keeper 44 that fits into barrel 26 and locks onto contoured insert 40.
3. Collapsible rod key coded tool head 46 that tightens keeper 44.

Figure 3:
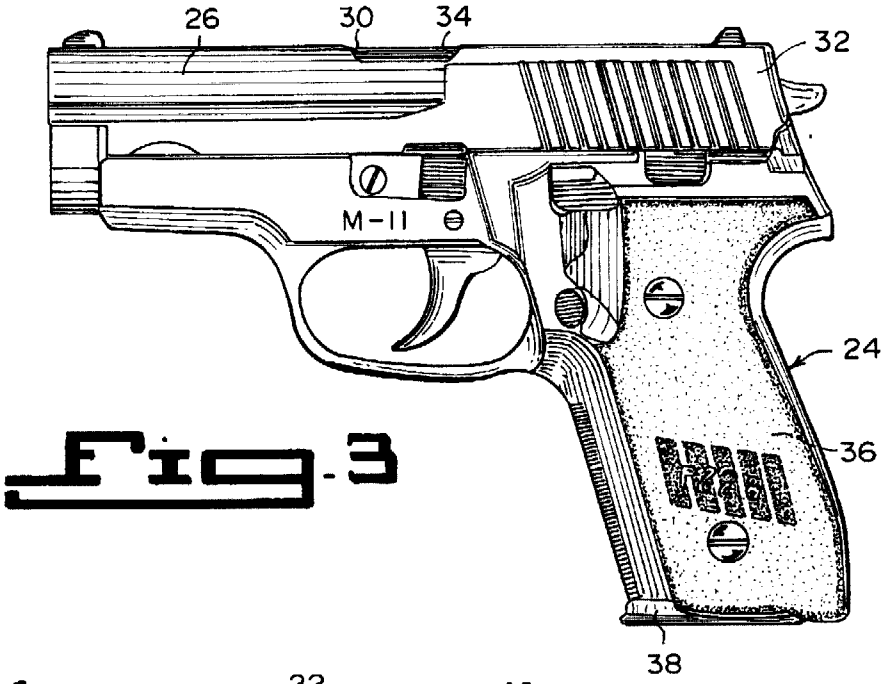
FIG. 3 is a left side elevational view of a firearm, which is an M-11 Sig-Sauer P 228.
Figure 3B:
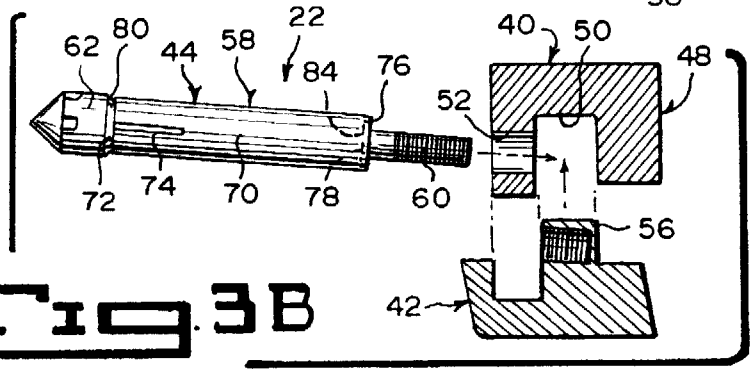
FIG. 3B is an exploded left side elevational view with parts in section, showing the contoured insert, dummy cartridge and keeper for the firearm of FIG. 3.
Figure 3A:
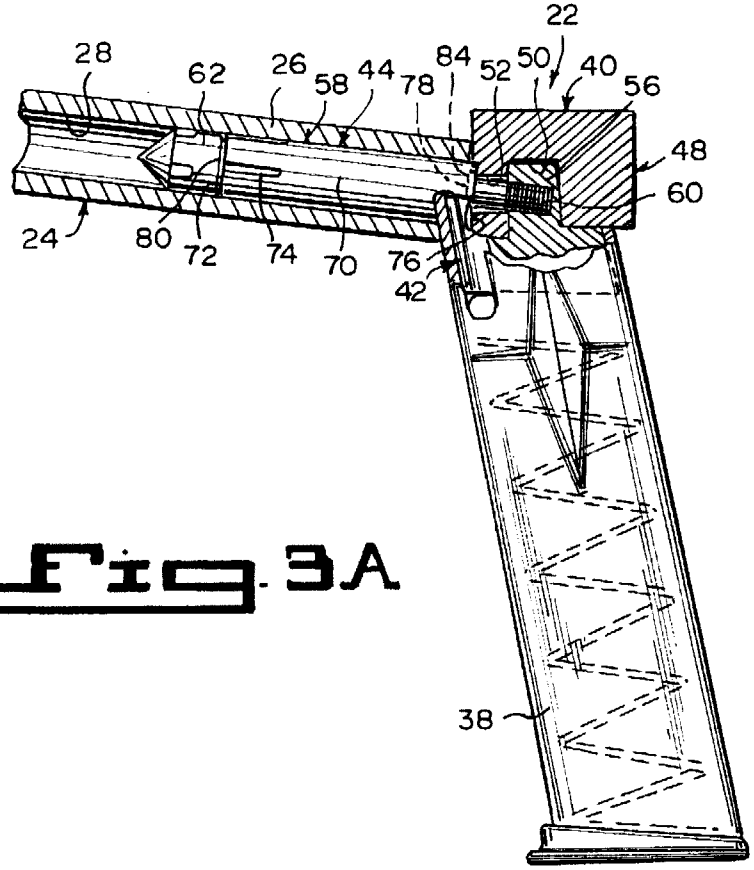
FIG. 3A is a left side elevational view with parts broken away and in section, showing the instant invention installed in place within the firearm of FIG. 3.
Figure 3C:
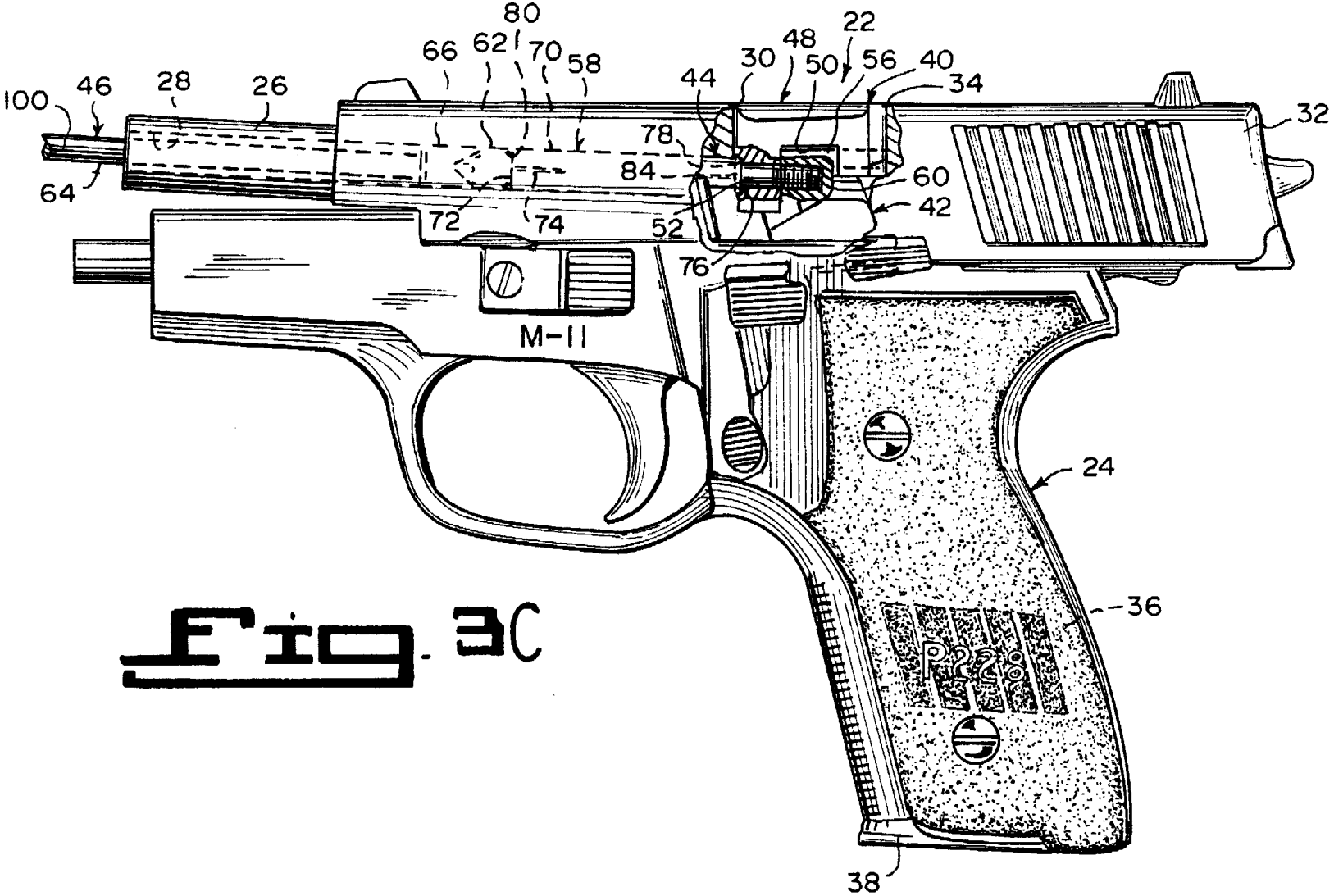
FIG. 3C is a left side elevational view of the firearm of FIG. 3 with parts broken away and in section, showing the instant invention installed therein.
Figure 3D:
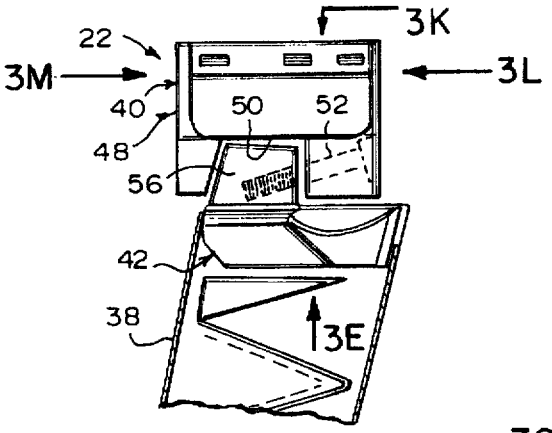
FIG. 3D is a right side elevational view opposite from FIG. 3A with the keeper removed, while the magazine is in section and broken away.
Figure 3E:
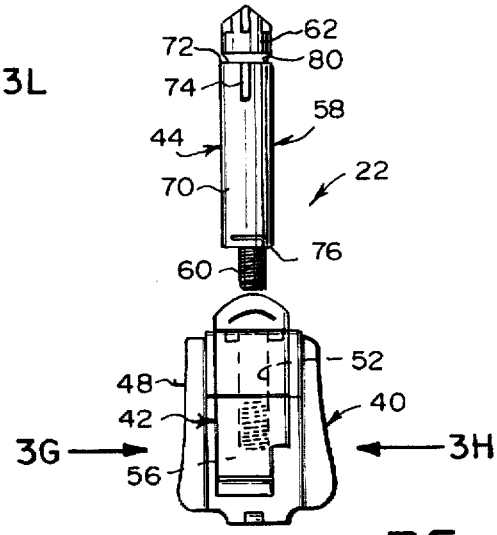
FIG. 3E is a bottom elevational view taken in the direction of arrow 3E in FIG. 3D, with the magazine removed and the keeper ready to be inserted.
Figure 3F:
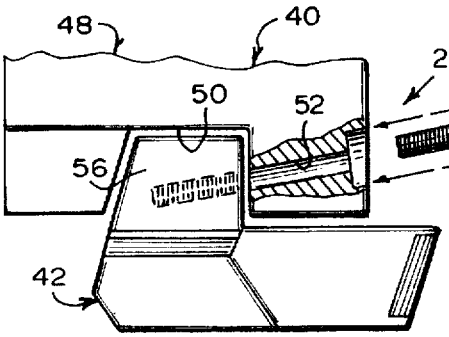
FIG. 3F is an enlarged right side elevational view with the contoured insert broken away and in section above the dummy cartridge, with the keeper broken away and ready to be inserted.
Figure 3G:
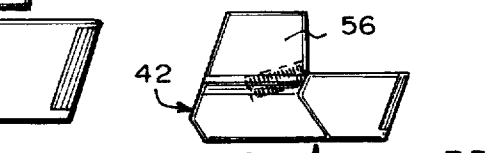
FIG. 3G is a right side elevational view of the dummy cartridge taken in the direction of arrow 3G in FIG. 3E.
Figure 3I:
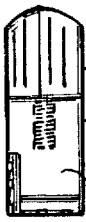
FIG. 3I is a top elevational view of the dummy cartridge taken in the direction of arrow 3I in FIG. 3G.
Figure 3H:
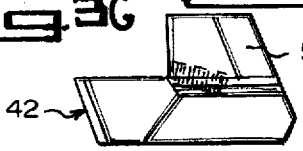
FIG. 3H is a left side elevational view of the dummy cartridge taken in the direction of arrow 3H in FIG. 3E.
Figure 3J:
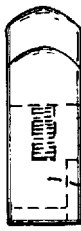
FIG. 3J is a bottom elevational view of the dummy cartridge taken in the direction of arrow 3J in FIG. 3G.
Figure 3K:
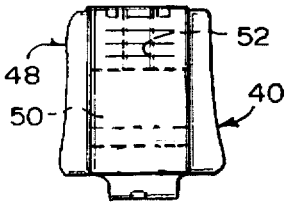
FIG. 3K is a top elevational view of the contoured insert taken in the direction of arrow 3K in FIG. 3D.
Figure 3L:
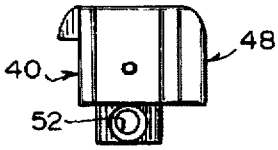
FIG. 3L is a front elevational view of the contoured insert taken in the direction of arrow 3L in FIG. 3D.
Figure 3M:
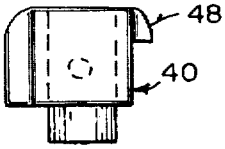
FIG. 3M is a rear elevational view of the contoured insert taken in the direction of arrow 3M in FIG. 3D.
Figure 5:
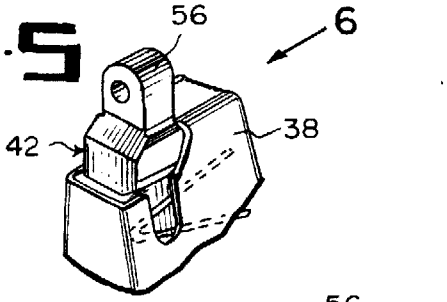
FIG. 5 is a front top perspective view taken in the direction of arrow 5 in FIG. 4 of just the dummy cartridge in the magazine.
Figure 6:
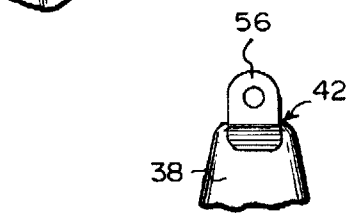
FIG. 6 is a rear elevational view taken in the direction of arrow 6 in FIG. 5.
Figure 4:
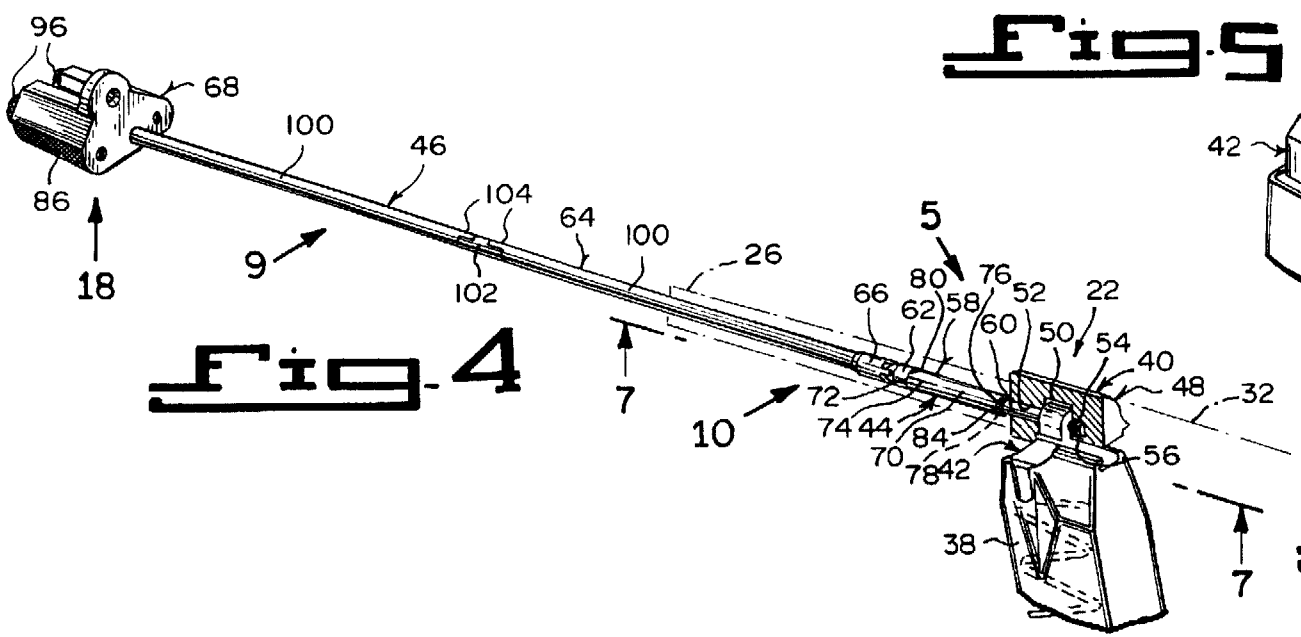
FIG. 4 is a perspective view with parts broken away, in section and in phantom phase, showing the collapsible rod key coded tool head securing the keeper to the contoured insert and the dummy cartridge in the magazine.
Figure 7:
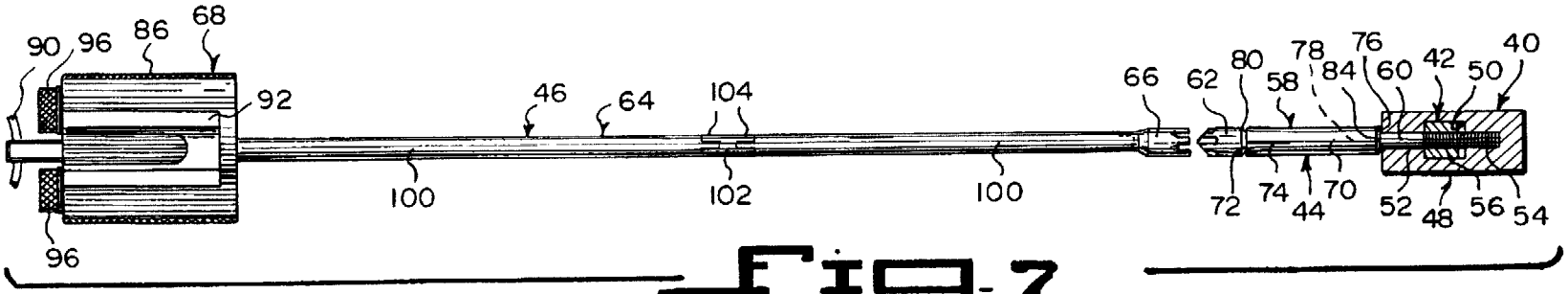
FIG. 7 is a cross sectional view taken along line 7—7 in FIG. 4.
Figures 8, 9, 10:
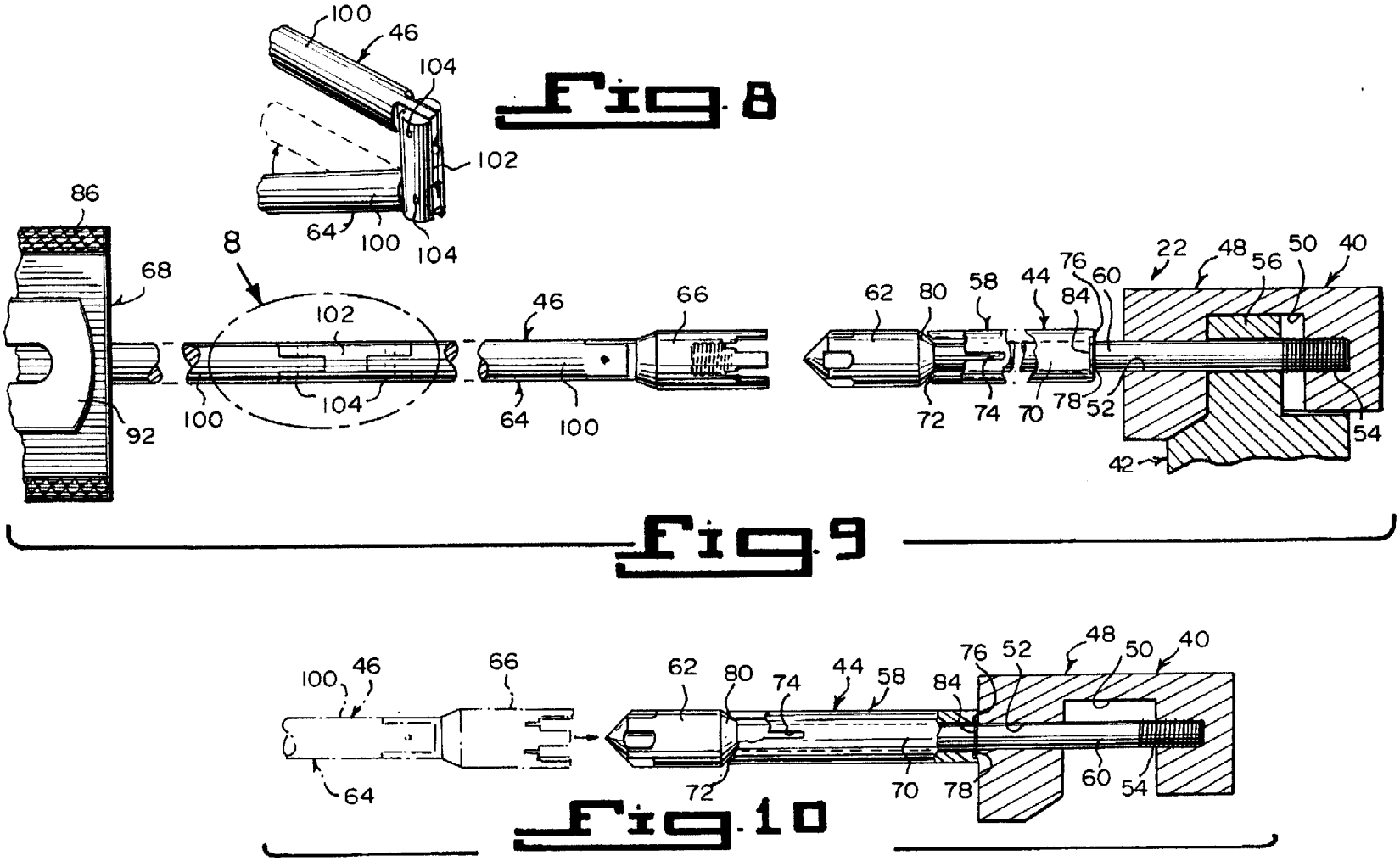
FIG. 8 is a perspective view as indicated by arrow 8 in FIG. 9, showing the log segments folded over the short segment of the elongated shaft.
FIG. 9 is a side elevational view taken in the direction of arrow 9 in FIG. 4, with the collapsible rod key coded tool head spaced away from the keeper.
FIG. 10 is a side elevational view taken in the direction of arrow 10 in FIG. 4, with part of the collapsible rod key coded tool head shown in phantom phase spaced away from the keeper and the dummy cartridge removed therefrom.
Figures 14, 15, 16:
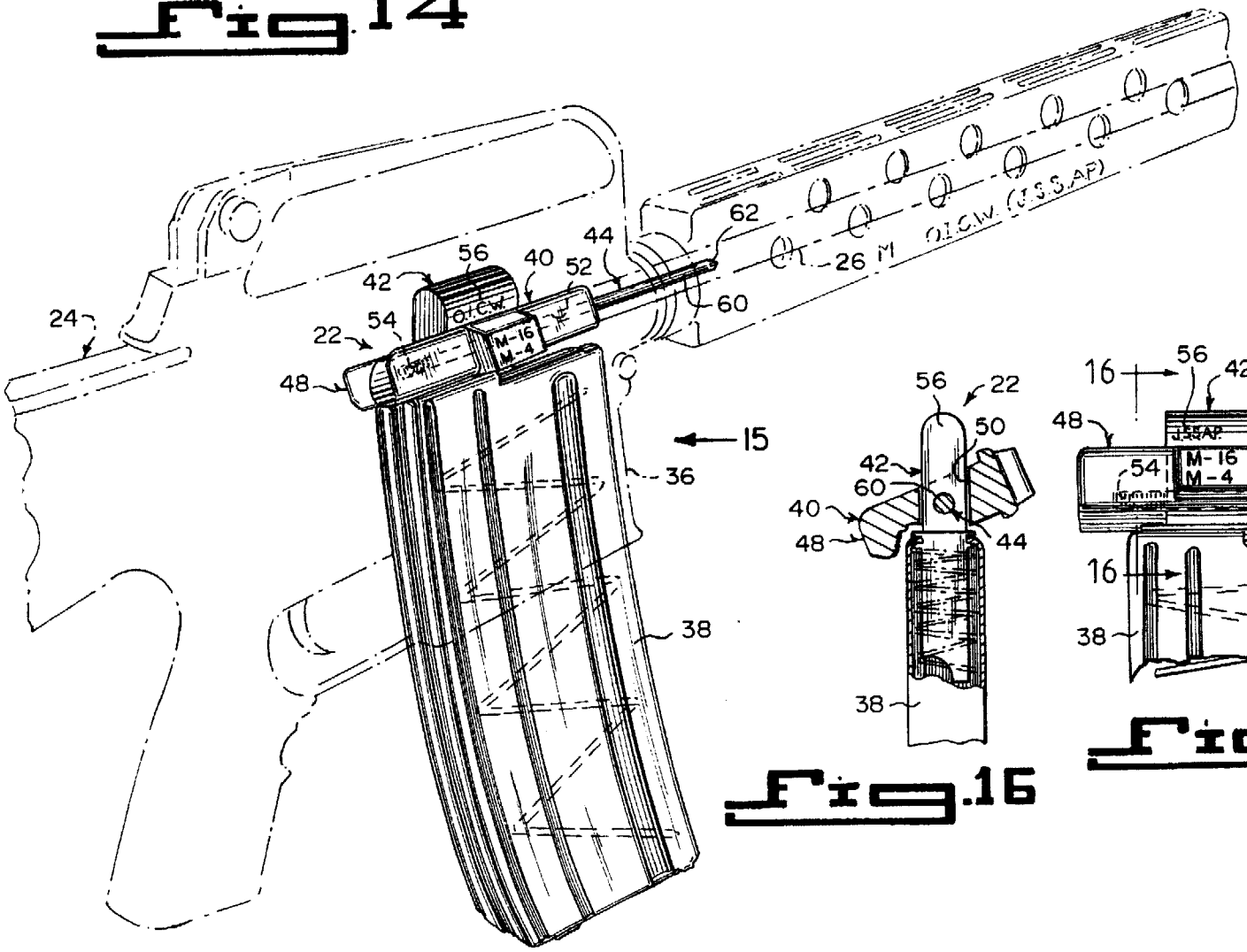
FIG. 14 is a rear top perspective view of a firearm, which is an M 16 M-4 O.I.C.W.(JSSAP) rifle shown in phantom phase with parts broken away, showing the instant invention in place.
FIG. 15 is a right side elevational view with parts broken away, taken in the direction of arrow 15 in FIG. 14.
FIG. 16 is a cross sectional view taken along line 16—16 in FIG. 15.

Used on the following manufactured firearms that do not have magazines:

(List is by no means exhaustive.)

a. shotguns b. pump action weapons c. bolt action weapons d. lever action weapons e. slide action f. internal slide action g. step loading without working the slide The firearm 24, as shown in FIGS. 1, 1A, 1B, 1F, 1G and 1I, is a 9 mm 92 SB-F Beretta pistol and is a top ejector. The contoured insert 40 is specially shaped for this weapon and is also shown in FIGS. 1C, 1D, 1E and 11. The firearm 24, as shown in FIGS. 2 and 2B, is a 0.45 caliber pistol and is a side ejector. The contoured insert 40 is specially shaped for this weapon and is also shown in FIGS. 12 and 13. The firearm 24, as shown in FIGS. 3, 3A and 3C is a Sig-Sauer P228M-11-9 mm pistol and is a top ejector. The contoured insert 40 is specially shaped for this weapon and is also shown in FIGS. 3B, 3D, 3E, 3F, 3K, 3L and 3M. The firearm 24, as shown in FIG. 14, is a M16 M-4OICW rifle and is a side ejector. The contoured insert 40 is specially shaped for this weapon and is also shown in FIGS. 15 and 16.

LIST OF REFERENCE NUMBERS

| | |
|---|---|
| 22 | tamper proof multi-functional multipurpose safety lock for 24 |
| 24 | firearm |
| 26 | barrel of 24 |
| 28 | bore in 26 |
| 30 | cartridge receiver firing chamber breech in 24 |
| 32 | slide of 24 |
| 34 | ejection port in 32 |
| 36 | magazine well in 24 |
| 38 | removable magazine in 36 |
| 40 | contoured insert of 22 in 30 |
| 42 | dummy cartridge in 38 for 40 |
| 44 | keeper |
| 46 | collapsible rod key coded tool head |
| 48 | generally block shaped member for 40 |
| 50 | centrally locked bottom socket in 48 |
| 52 | forward horizontal aperture in 48 |
| 54 | rearward horizontal threaded hole in 48 |
| 56 | upstanding lug on 42 |
| 58 | cylindrical housing of 44 |
| 60 | threaded shank of 44 |
| 62 | quadrilaterial shaped head of 44 |
| 64 | elongated shaft of 46 |
| 66 | quadrilaterial countersunk shaped socket on 64 |
| 68 | operating handle of 46 |
| 70 | hollow sleeve for 58 |
| 72 | open forward end of 70 |
| 74 | slot in 70 |
| 76 | closed rearward end of 70 |
| 78 | countersunk hole in 76 |
| 80 | quadrilaterial neck between 60 and 62 |
| 82 | countersunk octagon shaped groove in 60 |
| 84 | E-clip in 82 |
| 86 | knurled surface on 68 |
| 88 | transverse opening in 68 |
| 90 | key ring in 88 |
| 92 | belt clip on 68 |
| 94 | storage compartment in 68 |
| 96 | cap on 94 |
| 98 | wire brush cleaning element |
| 100 | long segment of 64 |
| 102 | short segment of 64 |
| 104 | hinge on 64 |
| 106 | adaptor for 46 |
| 108 | bridge head on 106 |
| 110 | hex socket adaptor in 106 |
| 112 | shank |
| 114 | hex head on 112 for 110 |
| 116 | Phillips head on 112 |

It will be understood that each of the elements described above, or two or more together may also find a useful application in other types of methods differing from the type described above.

While certain novel features of this invention have been shown and described are pointed out in the annexedclaims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A tamper proof multi-functional multipurpose safety lock for use in a firearm of the type having a barrel with a bore therethrough, a cartridge receiver firing chamber breech, a longitudinally movable slide with an ejection port and a magazine well for receiving a removable magazine that is capable of holding cartridges to be fed one at a time into the cartridge receiver firing chamber breech, the safety lock comprising:

a) a contoured insert that fits past the ejection port of the slide when the slide is in its most rearward position, so that said contoured insert can fit into the cartridge receiver firing chamber breech of the firearm;

b) a dummy cartridge that is carried on a top end of the magazine, so that when the magazine is inserted into the magazine well a portion of said dummy cartridge will engage with said contoured insert;

c) a keeper adapted to be inserted into the bore of the barrel of the firearm; and d) a collapsible rod key coded tool head insertable into the barrel of the firearm to engage said keeper, so that in a first instance said collapsible rod key coded tool head can cause said keeper to expand in the barrel and lock said dummy cartridge to said contoured insert, making the firearm inoperable by preventing the firearm from being fired, and in a second instance said collapsible rod key coded tool head can cause said keeper to unlock said dummy cartridge from said contoured insert, thus allowing said keeper to be removed from the bore of the barrel, the magazine to be removed from the magazine well, said dummy cartridge to be removed from the magazine and said contoured insert to be removed from the cartridge receiver firing chamber breech, making the firearm operable to be fired.

2. A tamper proof multi-functional multipurpose safety lock as recited in claim 1, wherein said contoured insert is a generally block shaped member, shaped to fit into the cartridge receiver firing chamber breech of the firearm, said block shaped member having a centrally located bottom socket vertically extending therein, a forward horizontal aperture and a rearward horizontal threaded hole that is in alignment with said forward horizontal aperture.

3. A tamper proof multi-functional multipurpose safety lock as recited in claim 2, wherein said dummy cartridge includes an upstanding lug which fits into said bottom socket in said block shaped member.

4. A tamper proof multi-functional multipurpose safety lock as recited in claim 3, wherein said keeper includes:

a) a cylindrical housing;

b) a threaded shank extending from a rearward end of said cylindrical housing to pass through said forward horizontal aperture, said upstanding lug and threads into said rearward horizontal threaded hole in said block shaped member; and c) a quadrilaterial shaped head extending from a forward end of said cylindrical housing to be operable by said collapsible rod key coded tool head.

5. A tamper proof multi-functional multipurpose safety lock as recited in claim 4, wherein said keeper further includes:

a) said cylindrical housing being a hollow sleeve having an open forward end with a plurality of slots thereabout and a closed rearward end having a countersunk hole therethrough; and b) a quadrilaterial neck connecting said quadrilaterial shaped head to said threaded shank which extends through said hollow sleeve and out of said countersunk hole, so that when said threaded shank is tightened into said rearward horizontal threaded hole in said block shaped member, said quadrilaterial neck will cause said open forward end of said hollow sleeve to expand and engage with the bore in the barrel of the firearm.

6. A tamper proof multi-functional multipurpose safety lock as recited in claim 5, wherein said keeper further includes:

a) said threaded shank having a countersunk octagon shaped groove thereabout at said countersunk hole in said closed rearward end of said hollow sleeve; and b) an E-clip flush on said countersunk octagon shaped groove in said threaded shank, to retain said hollow sleeve in a rotative position on said threaded shank.

7. A tamper proof multi-functional multipurpose safety lock as recited in claim 4, wherein said collapsible rod key coded tool head includes:

a) an elongated shaft having a quadrilaterial countersunk shaped socket at a first end to fit over said quadrilaterial shaped head on said keeper, so as to rotate said keeper to thread and unthread said threaded shank with said rearward horizontal threaded hole in said block shaped member; and b) an operating handle on a second end of said elongated shaft, so as to turn said elongated shaft.

8. A tamper proof multi-functional multipurpose safety lock as recited in claim 7, wherein said collapsible rod key coded tool head further including said operating handle having a knurled surface, so that a person can better grip said operating handle to turn said elongated shaft.

9. A tamper proof multi-functional multipurpose safety lock as recited in claim 7, wherein said collapsible rod key coded tool head further includes:

a) said operating handle having a transverse opening therethrough; and b) a key ring extending through said transverse opening, so that said collapsible rod key coded tool head can be carried by and stored on said key ring.

10. A tamper proof multi-functional multipurpose safety lock as recited in claim 7, wherein said collapsible rod key coded tool head further including a belt clip affixed to said operating handle, so that said collapsible rod key coded tool head can be attached by said belt clip to a belt worn on an individual person.

11. A tamper proof multi-functional multipurpose safety lock as recited in claim 7, wherein said collapsible rod key coded tool head further includes:

a) said operating handle having a pair of storage compartments for holding various oils, adaptors and currency therein; and b) a pair of caps, in which each said cap will removably seal one said compartment watertight in said operating handle when not in use.

12. A tamper proof multi-functional multipurpose safety lock as recited in claim 7, wherein said collapsible rod key coded tool head further including a pair of wire brush cleaning elements affixed to said operating handle, to be used for cleaning the firearm.

13. A tamper proof multi-functional multipurpose safety lock as recited in claim 7, wherein said collapsible rod key coded tool head further including said elongated shaft separated into two long segments and one short segment which is hinged between said two long segments, so that said elongated shaft can be folded upon itself for storage when not in use.

14. A tamper proof multi-functional multipurpose safety lock as recited in claim 7, wherein said collapsible rod key coded tool head further includes:

a) an adaptor having a bridge head at a first end to fit into said quadrilaterial countersunk shaped socket on said elongated shaft and a hex socket adaptor at a second end; and b) a shank having a hex head at a first end to fit into said hex socket in said adaptor and a Phillips head at a second end, so that said collapsible rod key coded tool head can now be converted into a Phillips head screwdriver.

15. A tamper proof multi-functional multipurpose safety lock as recited in claim 7, wherein said keeper further includes:

a) said cylindrical housing being a hollow sleeve having an open forward end with a plurality of slots thereabout and a closed rearward end having a countersunk hole therethrough; and b) a quadrilaterial neck connecting said quadrilaterial shaped head to said threaded shank which extends through said hollow sleeve and out of said countersunk hole, so that when said threaded shank is tightened into said rearward horizontal threaded hole in said block shaped member, said quadrilaterial neck will cause said open forward end of said hollow sleeve to expand and engage with the bore in the barrel of the firearm.

16. A tamper proof multi-functional multipurpose safety lock as recited in claim 15, wherein said keeper further includes:

a) said threaded shank having a countersunk octagon shaped groove thereabout at said countersunk hole in said closed rearward end of said hollow sleeve; and b) an E-clip flush on said countersunk octagon shaped groove in said threaded shank, to retain said hollow sleeve in a rotative position on said threaded shank.

17. A tamper proof multi-functional multipurpose safety lock as recited in claim 16, wherein said collapsible rod key coded tool head further including said operating handle having a knurled surface, so that a person can better grip said operating handle to turn said elongated shaft.

18. A tamper proof multi-functional multipurpose safety lock as recited in claim 17, wherein said collapsible rod key coded tool head further includes:

a) said operating handle having a transverse opening therethrough; and b) a key ring extending through said transverse opening, so that said collapsible rod key coded tool head can be carried by and stored on said key ring.

19. A tamper proof multi-functional multipurpose safety lock as recited in claim 18, wherein said collapsible rod key coded tool head further including a belt clip affixed to said operating handle, so that said collapsible rod key coded tool head can be attached by said belt clip to a belt worn on an individual person.

20. A tamper proof multi-functional multipurpose safety lock as recited in claim 19, wherein said collapsible rod key coded tool head further includes:

a) said operating handle having a pair of storage compartments for holding various oils, adaptors and currency therein; and b) a pair of caps, in which each said cap will removably seal one said compartment watertight in said operating handle when not in use.

21. A tamper proof multi-functional multipurpose safety lock as recited in claim 20, wherein said collapsible rod key coded tool head further including a pair of wire brush cleaning elements affixed to said operating handle, to be used for cleaning the firearm.

22. A tamper proof multi-functional multipurpose safety lock as recited in claim 21, wherein said collapsible rod key coded tool head further including said elongated shaft separated into two long segments and one short segment which is hinged between said two long segments, so that said elongated shaft can be folded upon itself for storage when not in use.

23. A tamper proof multi-functional multipurpose safety lock as recited in claim 22, wherein said collapsible rod key coded tool head further includes:

a) an adaptor having a bridge head at a first end to fit into said quadrilaterial countersunk shaped socket on said elongated shaft and a hex socket adaptor at a second end; and b) a shank having a hex head at a first end to fit into said hex socket in said adaptor and a Phillips head at a second end, so that said collapsible rod key coded tool head can now be converted into a Phillips head screwdriver.

24. A tamper proof multi-functional multipurpose safety lock for use in a firearm of the type having a barrel with a bore therethrough and a cartridge receiver firing chamber breech, the safety lock comprising:

a) a contoured insert that fits into the cartridge receiver firing chamber breech of the firearm, said contoured insert being a generally block shaped member shaped to fit into the cartridge receiver firing chamber breech of the firearm, said block shaped member having a horizontal threaded hole therethrough;

b) a keeper adapted to be inserted into the bore of the barrel of the firearm, said keeper including:

i) a cylindrical housing;

ii) a threaded shank extending from a rearward end of said cylindrical housing to thread into said horizontal threaded hole in said block shaped member; and iii) a quadrilaterial shaped head extending from a forward end of said cylindrical housing; and c) a collapsible rod key coded tool head insertable into the barrel of the firearm to engage and operate said quadrilaterial shaped head of said keeper, so that in a first instance said collapsible rod key coded tool head can cause said keeper to expand in the barrel and lock to said contoured insert, making the firearm inoperable by preventing the firearm from being fired, and in a second instance said collapsible rod key coded tool head can cause said keeper to unlock from said contoured insert, thus allowing said keeper to be removed from the bore of the barrel and said contoured insert to be removed from the cartridge receiver firing chamber breech, making the firearm operable to be fired.

25. A tamper proof multi-functional multipurpose safety lock as recited in claim 24, wherein said collapsible rod key coded tool head includes:

a) an elongated shaft having a quadrilaterial countersunk shaped socket at a first end to fit over said quadrilaterial shaped head on said keeper, so as to rotate said keeper to thread and unthread said threaded shank with said horizontal threaded hole in said block shaped member; and b) an operating handle on a second end of said elongated shaft, so as to turn said elongated shaft.

26. A tamper proof multi-functional multipurpose safety lock as recited in claim 24, wherein said keeper further includes:

a) said cylindrical housing being a hollow sleeve having an open forward end with a plurality of slots thereabout and a closed rearward end having a countersunk hole therethrough; and b) a quadrilaterial neck connecting said quadrilaterial shaped head to said threaded shank which extends through said hollow sleeve and out of said countersunk hole, so that when said threaded shank is tightened into said horizontal threaded hole in said block shaped member, said quadrilaterial neck will cause said open forward end of said hollow sleeve to expand and engage with the bore in the barrel of the firearm.

27. A tamper proof multi-functional multipurpose safety lock as recited in claim 26, wherein said keeper further includes:

a) said threaded shank having a countersunk octagon shaped groove thereabout at said countersunk hole in said closed rearward end of said hollow sleeve; and b) an E-clip flush on said countersunk octagon shaped groove in said threaded shank, to retain said hollow sleeve in a rotative position on said threaded shank.

28. A tamper proof multi-functional multipurpose safety lock as recited in claim 25, wherein said collapsible rod key coded tool head further including said operating handle having a partially knurled surface, so that a person can better grip said operating handle to turn said elongated shaft.

29. A tamper proof multi-functional multipurpose safety lock as recited in claim 25, wherein said collapsible rod key coded tool head further includes:

a) said operating handle having a transverse opening therethrough; and b) a key ring extending through said transverse opening, so that said collapsible rod key coded tool head can be carried on said key ring.

30. A tamper proof multi-functional multipurpose safety lock as recited in claim 25, wherein said collapsible rod key coded tool head further including a belt clip affixed to said operating handle, so that said collapsible rod key coded tool head can be attached by said belt clip to a belt worn on an individual person.

31. A tamper proof multi-functional multipurpose safety lock as recited in claim 25, wherein said collapsible rod key coded tool head further includes:

a) said operating handle having a pair of storage compartments for holding various oils, adaptors and currency therein; and b) a pair of caps, in which each said cap will removably seal one said compartment watertight in said operating handle when not in use.

32. A tamper proof multi-functional multipurpose safety lock as recited in claim 25, wherein said collapsible rod key coded tool head further including a pair of wire brush cleaning elements affixed to said operating handle, to be used for cleaning the firearm.

33. A tamper proof multi-functional multipurpose safety lock as recited in claim 25, wherein said collapsible rod key coded tool head further including said elongated shaft separated into two long segments and one short segment which is hinged between said two long segments, so that said elongated shaft can be folded upon itself for storage when not in use.

34. A tamper proof multi-functional multipurpose safety lock as recited in claim 25, wherein said collapsible rod key coded tool head further includes:

a) an adaptor having a bridge head at a first end to fit into said quadrilaterial countersunk shaped socket on said elongated shaft and a hex socket adaptor at a second end; and b) a shank having a hex head at a first end to fit into said hex socket in said adaptor and a Phillips head at a second end, so that said collapsible rod key coded tool head can now be converted into a Phillips head screwdriver.

35. A tamper proof multi-functional multipurpose safety lock as recited in claim 25, wherein said keeper further includes:

a) said cylindrical housing being a hollow sleeve having an open forward end with a plurality of slots thereabout and a closed rearward end having a countersunk hole therethrough; and b) a quadrilaterial neck connecting said quadrilaterial shaped head to said threaded shank which extends through said hollow sleeve and out of said countersunk hole, so that when said threaded shank is tightened into said horizontal threaded hole in said block shaped member, said quadrilaterial neck will cause said open forward end of said hollow sleeve to expand and engage with the bore in the barrel of the firearm.

36. A tamper proof multi-functional multipurpose safety lock as recited in claim 35, wherein said keeper further includes:

a) said threaded shank having a countersunk octagon shaped groove thereabout at said countersunk hole in said closed rearward end of said hollow sleeve; and b) an E-clip flush on said countersunk octagon shaped groove in said threaded shank, to retain said hollow sleeve in a rotative position on said threaded shank.

37. A tamper proof multi-functional multipurpose safety lock as recited in claim 36, wherein said collapsible rod key coded tool head further including said operating handle having a knurled surface, so that a person can better grip said operating handle to turn said elongated shaft.

38. A tamper proof multi-functional multipurpose safety lock as recited in claim 37, wherein said collapsible rod key coded tool head further includes:

a) said operating handle having a transverse opening therethrough; and b) a key ring extending through said transverse opening, so that said collapsible rod key coded tool head can be carried on said key ring.

39. A tamper proof multi-functional multipurpose safety lock as recited in claim 38, wherein said collapsible rod key coded tool head further including a belt clip affixed to said operating handle, so that said collapsible rod key coded tool head can be attached by said belt clip to a belt worn on an individual person.

40. A tamper proof multi-functional multipurpose safety lock as recited in claim 39, wherein said collapsible rod key coded tool head further includes:

a) said operating handle having a pair of compartments for holding various oils, adaptors and currency therein; and b) a pair of caps, in which each said cap will removably seal one said compartment watertight in said operating handle when not in use.

41. A tamper proof multi-functional multipurpose safety lock as recited in claim 40, wherein said collapsible rod key coded tool head further including a pair of wire brush cleaning elements affixed to said operating handle, to be used for cleaning the firearm.

42. A tamper proof multi-functional multipurpose safety lock as recited in claim 41, wherein said collapsible rod key coded tool head further including said elongated shaft separated into two long segments and one short segment which is hinged between said two long segments, so that said elongated shaft can be folded upon itself for storage when not in use.

43. A tamper proof multi-functional multipurpose safety lock as recited in claim 42, wherein said collapsible rod key coded tool head further includes:

a) an adaptor having a bridge head at a first end to fit into said quadrilaterial countersunk shaped socket on said elongated shaft and a hex socket adaptor at a second end; and b) a shank having a hex head at a first end to fit into said hex socket in said adaptor and a Phillips head at a second end, so that said collapsible rod key coded tool head can now be converted into a Phillips head screwdriver.

* * * * *